US005497897A

United States Patent [19]

Alack et al.

[11] Patent Number: 5,497,897

[45] Date of Patent: Mar. 12, 1996

[54] CONTAINER FOR HOLDING FLUENT MATERIAL

[75] Inventors: Charles S. Alack, St. Louis; Benjamin A. Wanner, Hillsboro, both of Mo.

[73] Assignee: Semi-Bulk Systems, Inc., St. Louis, Mo.

[21] Appl. No.: 222,083

[22] Filed: Mar. 31, 1994

[51] Int. Cl.[6] ..... B65D 45/32

[52] U.S. Cl. ..... 220/320; 220/565

[58] Field of Search ..... 220/565, 320, 220/319

[56] References Cited

U.S. PATENT DOCUMENTS

| | | | |
|---|---|---|---|
| 310,210 | 1/1885 | Liedel . | |
| 2,297,835 | 10/1942 | Levengood | 15/56 |
| 2,637,477 | 5/1953 | Tucker | 226/59 |
| 2,954,203 | 9/1960 | Carter | 249/64 |
| 3,818,550 | 6/1974 | Cresswell | 24/243 K |
| 4,194,312 | 3/1980 | Connors et al. | 38/102.5 |
| 4,205,930 | 6/1980 | Handleman et al. | 406/90 |
| 4,267,940 | 5/1981 | Wade | 220/320 |
| 4,294,377 | 10/1981 | Chen | 220/320 |
| 4,467,504 | 8/1984 | Quist | 24/460 |
| 4,662,038 | 5/1987 | Walker | 24/460 |
| 4,842,228 | 6/1989 | Kasper | 248/97 |
| 4,982,864 | 1/1991 | Kusta | 220/320 |
| 4,998,643 | 3/1991 | Pradel | 220/320 |

*Primary Examiner*—Joseph M. Moy

*Attorney, Agent, or Firm*—Senniger, Powers, Leavitt & Roedel

[57] ABSTRACT

A container for holding fluent material comprises a bag of flexible sheet material defining a volume for containing a load of the material. The bag has a side wall with an inside face and an outside face, and a bottom margin defining an open lower end of the bag. The container further comprises a substantially rigid, non-circular base for supporting the bag. Channels are formed in the base and extend at least partially around the base. The bag is fitted on the base with the bottom margin of the bag extending down on the outside of the base and with a portion of the bottom margin received in the channels of the base. Locking strips are positioned in the channels to overlie the portion of the bottom margin of the bag received therein. The container further comprises a clamping mechanism securable to the base for applying pressure to the locking strips to press the portion of the bottom margin of the bag against one or more surfaces of the channels thereby to sealingly secure the bag to the base.

21 Claims, 3 Drawing Sheets

CONTAINER FOR HOLDING FLUENT MATERIAL

BACKGROUND OF THE INVENTION

This invention relates generally to material handling apparatus and more particularly to a container having a non-circular base supporting a flexible bag for sealingly holding a load of fluent material, such as a fine granular, particulate or powdered material.

The container of this invention represents an improvement over the container disclosed in coassigned U.S. Pat. No. 4,149,755 and commercially available from the assignee of this invention, Semi-Bulk Systems, Inc. of St. Louis, Mo. under registered trademark AIR PALLET. The latter container has a pallet base with a generally circular horizontal periphery which supports a generally cylindric bag of flexible material for containing a load of powder or other fluent material. While this container has proven to be generally satisfactory, the generally circular periphery of the pallet base and the corresponding generally cylindric shape of the bag is not space efficient for packing or grouping a number of containers closely together in side-by-side relation (e.g., loading a truck). A substantial amount of space is wasted between pallet bases because of their generally circular shape. This results in higher storage and transportation costs. Moreover, a bag of generally circular shape in transverse (horizontal) cross section is somewhat unstable and has a tendency to tilt on its base, especially if the material in the bag is relatively loosely packed.

While non-circular (e.g., rectangular) containers are more space efficient, it is difficult to obtain a sealing connection between a bag and a base of non-circular configuration. Annular clamp designs of the type disclosed in the aforementioned U.S. Pat. No. 4,149,755 will not provide a uniform seal when used on a container which is rectangular, for example. Even if the clamp is designed to have a rectangular shape corresponding to that of the base, the long straight sections of the clamp corresponding to the straight sides of the base and bag cannot provide a sufficient inward force to seal the bag against the base. Consequently, a sealing connection between the bag and the base is not achieved and leakage results. It will be noted in this regard that the product in such containers is often conditioned (fluidized) by the introduction of pressurized air into the bag to facilitate unloading of product from the bag. Unless there is a tight seal between the bag and the container, pressurized air and/or product will leak from the bag, which reduces the efficiency of the unloading process.

SUMMARY OF THE INVENTION

Among the several objects and features of the present invention may be noted the provision of a non-circular container which is more space efficient for packing or grouping a number of containers closely together in side-by-side relation; the provision of such a container which is configured to be more stable and less likely to tilt when filled with a load of fluent material; the provision of such container incorporating a unique clamping design which is capable of sealing a non-circular bag to a non-circular base, the resultant seal being effective for preventing leakage of product and/or air from the bag during a fluidization process; the provision of such container which is reusable; and the provision of a container which reduces transportation and storage costs.

Generally, an improved container of this invention comprises a bag of flexible sheet material defining a volume for containing a load of material. The bag has a side wall with an inside face and an outside face, and a bottom margin defining an open lower end of the bag. The container further includes a substantially rigid, non-circular base for supporting the bag. Channel means is formed in the base and extends at least partially around the base. The bag fits on the base with the bottom margin of the bag extending down on the outside of the base and a portion of the bottom margin received in the channel means. Locking strip means is positioned in the channel means to overlie the portion of the bottom margin of the bag received in the channel means. The container further comprises a clamping mechanism securable to the base for applying pressure to the locking strip means to press the portion of the bottom margin of the bag in the channel means against one or more surfaces of the channel means thereby to sealingly secure the bag to the base.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
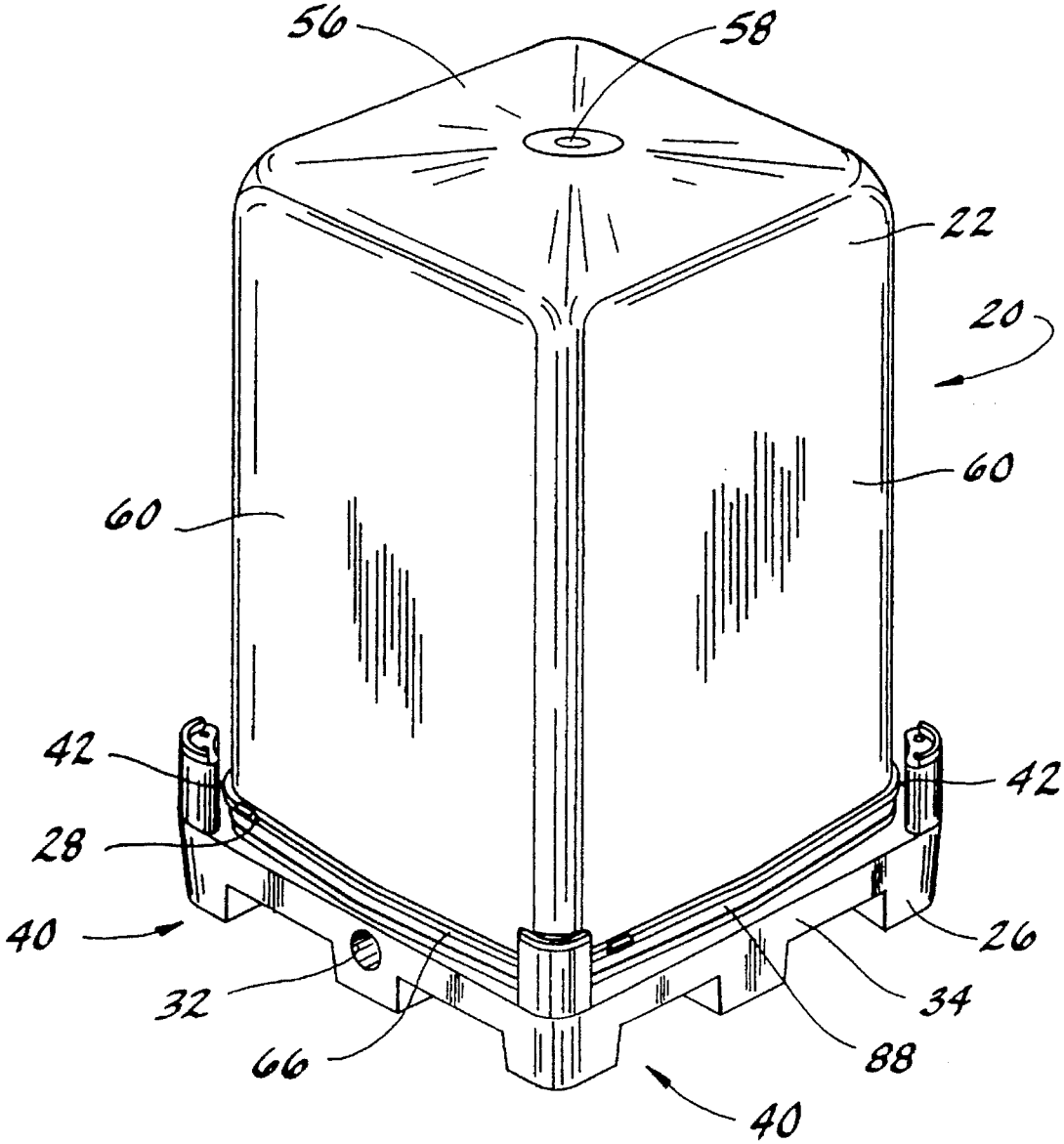
FIG. 1 is a perspective showing a container of this invention.

Referring now to the drawings, a container for transporting and storing a load of fine granular, particulate, powdered or other conditionable (fluidizable) material is indicated generally at 20. As shown in FIG. 1, the container 20 comprises a bag 22 of flexible material defining a volume for containing a load of fluent material 24 (FIG. 2), a substantially rigid, non-circular base 26 for supporting the bag, and a clamping mechanism 28 securable to the base to sealingly secure the bag to the non-circular base.

Figure 2:
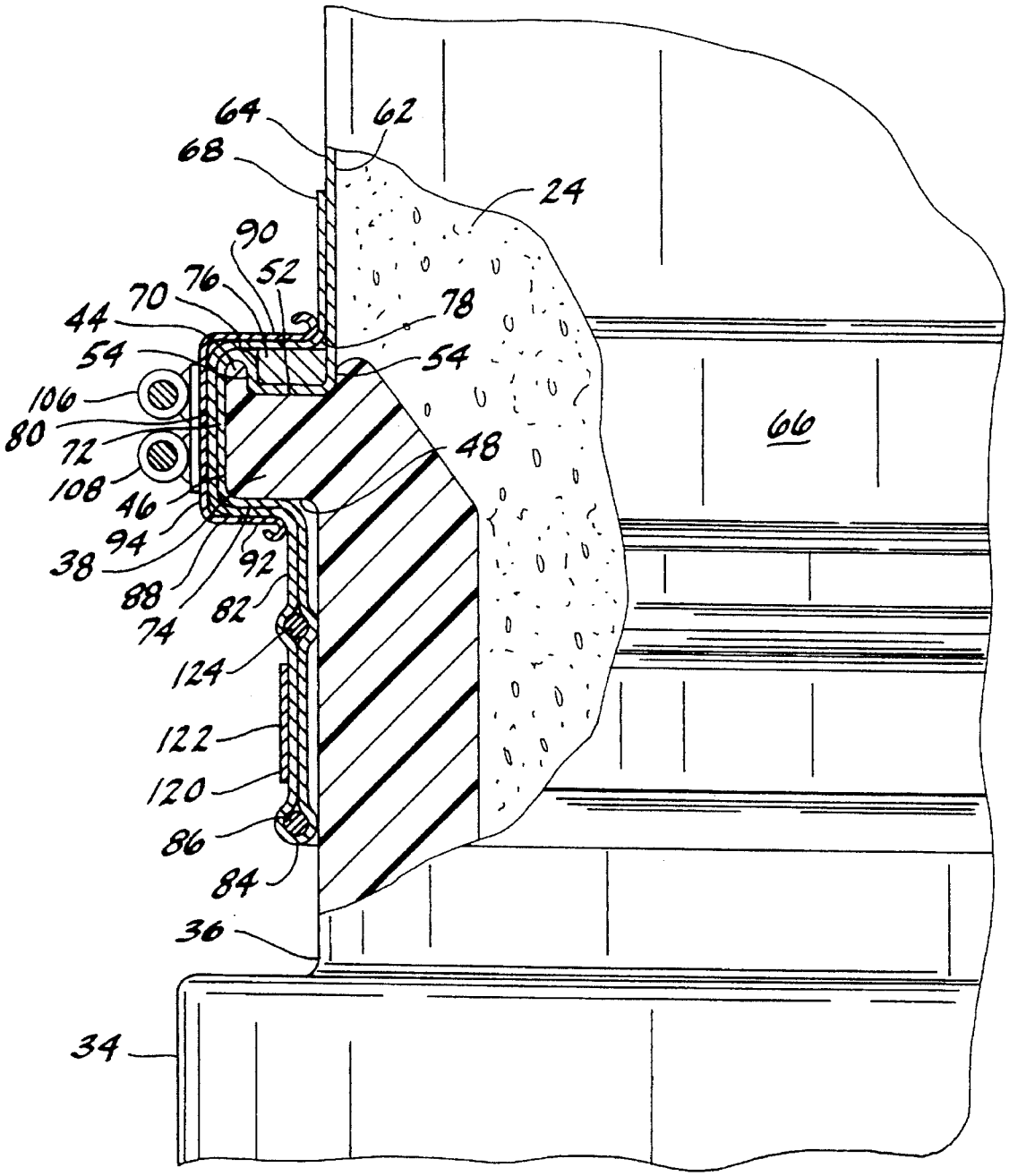
FIG. 2 is an enlarged side elevational view of a portion of FIG. 1 showing a clamp securing a bag to a base of the container, parts of the container being broken away to illustrate details.
Figure 3:
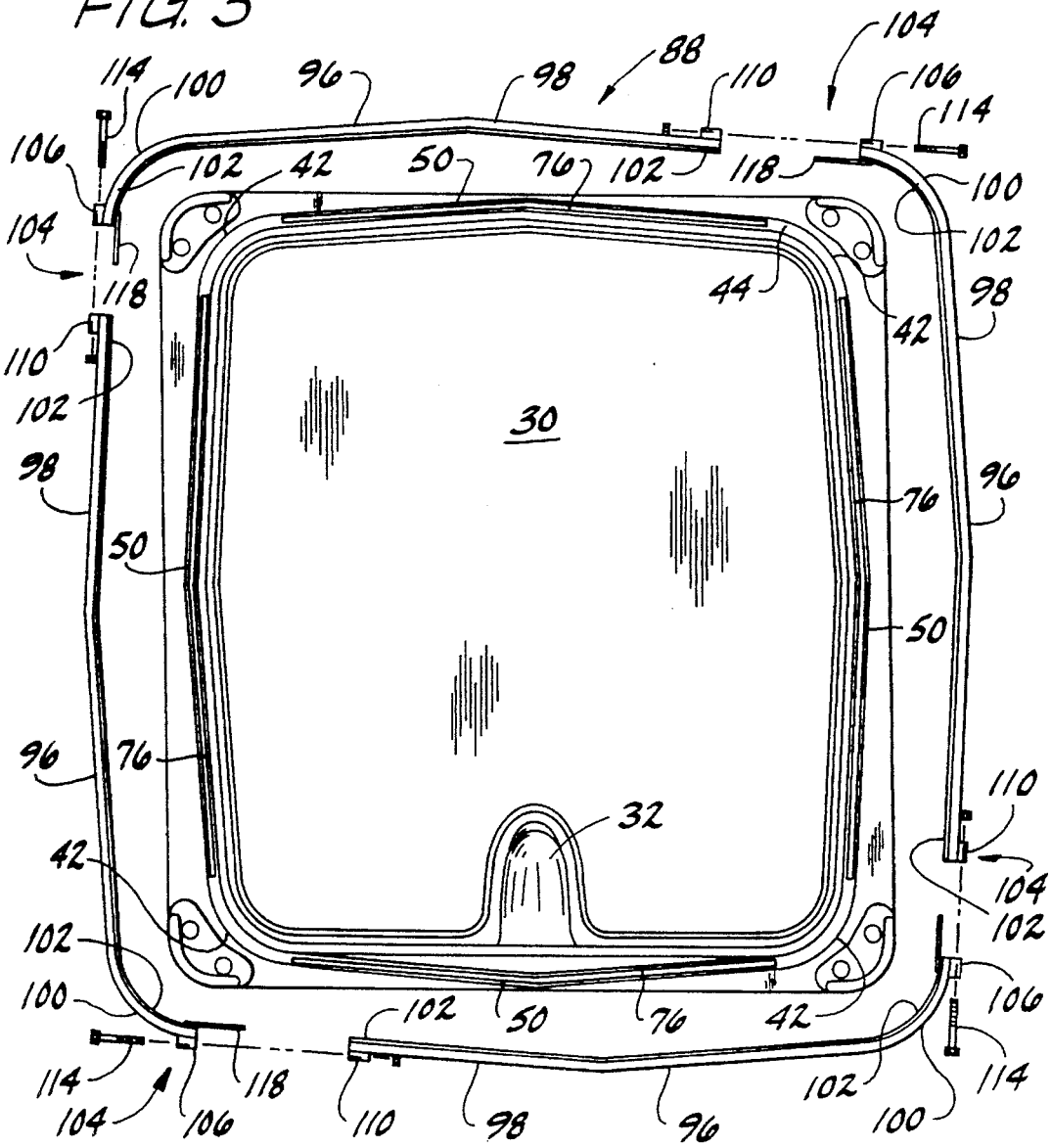
FIG. 3 is a top plan view of the base and clamp of FIG. 2, the clamp being exploded away from the base for clarity.

The base 26 is a one-piece pallet preferably molded of a suitable synthetic resin material (e.g., high-density polyethylene). The base 26 comprises a generally planar load supporting deck 30 inclined downwardly toward one side of the pallet base (FIG. 3), a gas-permeable membrane (not shown) overlying the deck, a gas inlet (not shown) at one side of the base for the introduction of pressurized gas into the container and an outlet opening 32 for the discharge of conditioned (fluidized) material 24 from the container 20. As shown in FIG. 2, the base 26 has an outer, generally vertical peripheral wall 34 defining the outside of the pallet, a bag receiving wall 36 recessed from the outer peripheral wall and extending upwardly therefrom, and an outwardly projecting peripheral flange 38 extending around the pallet base at the top of the bag receiving wall. The base 26 is generally rectangular in shape, having opposite sides and opposite ends, each indicated generally at 40 (FIG. 1). The flange 38 and bag receiving wall 36 likewise have a generally rectangular periphery with rounded corners, each indicated generally at 42, the flange bowing laterally outwardly at opposite sides and opposite ends of the base (FIG. 3).

As depicted in FIG. 2, the peripheral flange 38 includes an upper surface 44, an outer face 46 extending down from the upper surface and a lower surface 48 extending inwardly from the outer face to the bag receiving wall 36 of the base 26. For reasons which will become apparent, the flange 38 is formed with channel means comprising a plurality of channels, each indicated generally at 50, in the upper surface 44 of the flange. As shown in FIG. 3, a channel 50 is formed at each side and each end 40 of the base 26, and each channel extends substantially the full length of the side or end and terminates short of the rounded corners 42. Each channel 50 is configured to have a generally flat bottom 52 and a pair of generally vertical side walls 54 (FIG. 2) (other channel configurations may also be suitable). The channels 50 are bowed generally to correspond to the bowed shape of the flange 38 at opposite sides and ends 40 of the base.

The bag 22 has a non-circular configuration generally corresponding to the shape of the base 26. As illustrated in FIG. 1, this configuration is rectangular, the bag having a top wall 56 with an opening 58 for filling the container 20 with the conditionable material 24, and four side walls, each indicated at 60. Each side wall 60 has an inside face 62 and an outside face 64 (FIG. 2). The bag 22 also has a bottom margin 66 defining an open lower end of the bag, and a hem 68 formed around the bottom margin on the outside faces 64 of the side walls of the bag. The bag 22 is preferably formed of a tough, gas and water impervious flexible sheet material, such as a high tensile strength cloth coated or laminated with a suitable plastic or rubber coating. For example, a polyester fabric coated with polyvinyl chloride on both faces may be used. Of course, other limp sheet materials, such as suitable plastic film, may be used. The open lower end of the bag 22 overlies the gas-permeable membrane of the base 26, and gas introduced through the gas inlet flows up through the membrane of the base and into the volume defined by the bag via its open lower end to condition the material 24 within the container 20 for unloading.

The bag 22 is fitted on the base 26 with the bottom margin 66 and hem 68 of the bag extending down over the flange 38 and on the outside of the bag receiving wall 36, as shown in FIG. 2. More specifically, the bottom margin 66 of the bag 22 includes an upper portion 70 which extends laterally outwardly from the side wall 60 of the bag across the upper surfaces 44 of the flange 38 and into the channels 50 formed therein, an outer portion 72 extending down from the upper portion on the outside of the outer face 46 of the flange and a lower portion 74 extending laterally inwardly from the outer portion to underlie the lower surface 48 of the flange and further extending down on the bag receiving wall 36.

Locking strip means comprising a plurality of locking strips generally designated 76 are received in the channels 50 formed in the upper surface 44 of the peripheral flange 38 at opposite sides and opposite ends 40 of the base 26 (FIG. 3). The locking strips 76 are made of a stiff but bendable material, such as polyethylene or metal, and are bent generally to correspond to the shape of the channels 50. Each strip 76 has a cross-sectional shape corresponding to that of its respective channel 50 (e.g., rectangular) and extends substantially the full length of the channel. The locking strips 76 are positioned in the channels 50 to overlie the portion of the bottom margin 66 of the bag 22 received in the channels (FIG. 2). Each locking strip 76 preferably has a width which is only slightly less than the width of the channel 50 between the side walls 54 thereof so that the portion of the bottom margin 66 of the bag 22 received in each channel 50 is squeezed between the respective locking strip and side walls of the channel.

The hem 68 of the bag 22 has an upper hem portion 78 overlying the upper surface 44 of the flange 38 and locking strips 76, an outer hem portion 80 extending down from the upper hem portion on the outside of the outer portion 72 of the bottom margin 66 of the bag 22, and a lower hem portion 82 extending laterally inwardly from the outer hem portion on the underside of the lower portion 74 of the bottom margin of the bag. The lower hem portion 82 extends to the bag-receiving wall 36 and then down on the bag receiving wall. The hem 68 and bottom margin 66 of the bag 22 are integrally joined along their entire perimeter at a fold line, indicated at 84. As illustrated in FIG. 2, a rope cord 86 at the junction of the hem 68 and bottom margin 66 holds the bag 22 tight against the bag receiving wall 36 of the base 26.

As shown in FIG. 1, the clamping mechanism 28 for sealingly securing the bag 22 to the base 26 comprises an annular clamp 88 which fits tightly on the flange 38 around the periphery of the base. The clamp 88 is generally channel-shaped in transverse cross section (FIG. 2). It has an upper rim 90 overlying the upper surface 44 of the flange 38 and the locking strips 76, a lower rim 92 underlying the lower surface 48 of the flange, and a web 94 connecting the upper and lower rims on the outside of the outer face 46 of the flange. The clamp 88 is preferably made of stiff metal, such as 0.043 gauge stainless steel, which is resiliently flexible to some degree to compensate for tolerances. The clamp 88 is preferably configured so that its upper rim 90 is angled slightly downwardly (e.g., approximately 1° angle relative to horizontal) to provide greater clamping pressure on the locking strips 76 to hold the strips in the channels 50 and to press the strips down against the portion of the bag 22 received in the channel.

The annular clamp 88 comprises four separate, generally J-shaped segments (FIG. 3), each indicated generally at 96. Each segment 96 has a relatively long section 98 extending along a respective side or end 40 of the base 26 and a curved section 100 extending around a respective corner 42 of the base. Each end 102 of each J-shaped segment 96 is connected to an adjacent segment by means of a connector generally designated 104. The connectors 104 are operable to draw the ends 102 of the segments 96 toward one another to tighten the clamp 88 on the flange 38.

Figure 4:
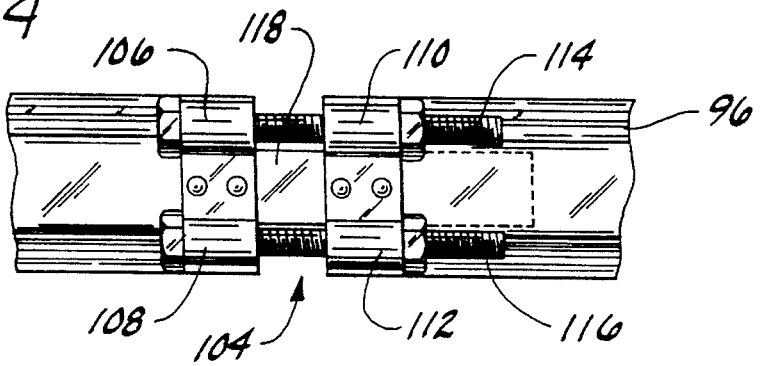
FIG. 4 is an enlarged side elevational view of a connector securing the clamp to the base of the container.

As shown in FIG. 4, each connector comprises a first pair of upper and lower tubular barrels 106, 108 respectively, attached to one end 102 of a respective J-shaped segment and a second pair of upper and lower barrels 110, 112 respectively, attached to a respective end of an adjacent J-shaped segment. The first pair of upper and lower barrels 106, 108 opposes the second pair of upper and lower barrels 110, 112 for receiving upper and lower bolts 114, 116. Each end 102 of the J-shaped segments 96 can thus be coupled to an end of an adjacent J-shaped segment by inserting upper and lower bolts 114, 116 into the upper and lower barrels 106, 110 and 108, 112, respectively. By tightening the bolts 114, 116, the annular clamp 88 may be tightened a desired amount within the limits of the bolts. Each connector 104 further includes a resilient tongue 118 of relatively thin gauge stainless steel or the like which is secured to one end 102 of each J-shaped segment 96 and extends under the end of an adjacent J-shaped segment to protect the bag 22 from damage (e.g., tearing) when the connector is tightened and to seal at the joint. While the connector 104 has been described as a bolt tightening arrangement, other type of tensioning devices, such as overcenter buckles and the like may be used.

The clamping mechanism 28 of the container 20 further includes a safety clamp 120 which assists in holding the bag 22 in place on the base 26 during pressurization of the bag (FIG. 2). The safety clamp 120 comprises a metal band 122 which extends around the bag-receiving wall 36 of the base 26 on the outside of the bottom margin 66 of the bag 22 in a position above the cord 86. The band 122 is suitably affixed to the base 26, as by rivets, and holds the lower portion of the hem and bottom margin 82, 74 of the bag in place on the base (the cord 86 restricts upward movement of the bag past the band). In the illustrated embodiment, a second cord 124 is provided between the lower portion of the hem 82 and the bottom margin 74 of the bag 22 at a position above the safety clamp 120. The second cord 124 helps to restrain the bag 22 against being pulled past the annular clamp 88 should the safety clamp 120 fail to hold the bag in place on the base 26.

The clamping mechanism 28 applies pressure to the locking strips 76 to press the portion of the bottom margin 66 of the bag received in the channels 50 against one or more surfaces of the channels to seal the bag 22. More specifically, the annular clamp 28 applies downward pressure on the locking strips 76 to force the strips into the channels 50 and hold them therein. As previously described, the strips 76 are configured to have a width which is only slightly less than the width of the channels 50. The portion of the bag 22 received in each channel 50 is thus jammed between the side walls 54 of the channel and its respective locking strip 76 to seal the bag against the side walls of the channels. In the illustrated embodiment, the portion of the bag 22 received in the channel 50 is also sealed against the bottom 52 of the channel. To this end, the combined thickness of the locking strip 76 and bottom margin 66 of the bag 22 received in each channel 50 is preferably greater than the depth of the channel by at least the thickness of the bottom margin. The result is that the clamp 88 applies downward pressure to the locking strips 76 to press the portion of the bottom margin 66 received in the channels 50 against the bottom surface 52 of the channels thereby sealing the bag 22 against the bottom surface of the channels. The downwardly angled upper rim 90 provides greater clamping pressure on the locking strips 76 to insure a tight seal. Sealing the bag 22 to the base 26 prevents leakage of gas and product 24 from within the bag upon pressurization thereof. It will be understood that the bag 22 can be sealingly secured against only the side walls 54 of the channel 50 or only against the bottom 52 of the channel and still be within the scope of the invention.

The annular clamp 88 also sealingly secures the bag 22 at the rounded corners 40 of the flange 38. Tightening the clamp 88 on the flange 38 presses portions of the bottom margin 66 and hem 68 of the bag trapped between the clamp and outer face 46 of the flange against the outer face of the flange thereby sealing the bag 22.

To use a container 20 of this invention, the bag 22 and annular clamp 88 are secured to the base 26 in the above-described manner. A load of fluent material 24 is then introduced into the bag 22 via opening 58 of the bag to fill the volume. The generally rectangular periphery of the bag 22, as shown in FIG. 1, stabilizes the container 20 and helps to prevent it from tipping during handling, transportation and storage of the container and further enables the containers to be packed closely together in side-by-side relation without the wasted space inherent when packing cylindrically shaped containers next to one another.

To unload material from the container 20, gas is introduced into the container via the gas inlet and flows up through the membrane of the base 26 into the volume defined by the bag 22 to condition the product 24 therewithin. During conditioning (fluidization) of the load 24, the clamping mechanism 28 holds the bag 22 securely on the base 26 and provides a seal against the leakage of gas and product from within the bag. Fluidized product 24 from within the bag 22 is discharged from the container 20 via the outlet 32. As disclosed in the above-mentioned U.S. Pat. No. 4,149,755, a discharge conduit or hose (not shown) is removably inserted into the discharge opening 32 of the pallet 26 so that product 24 discharged therefrom can be conveyed to a desired location. The container 20 can then be reloaded with product 24 as described above and reused.

It will be understood that a variety of different films and bag configurations may be used in a container 20 of this invention depending on the quantity of product 24 to be contained in the bag 22, the characteristics (i.e., density, toxicity, etc.) of the product, the number of desired reuses of the container, and other parameters.

It will be observed from the foregoing that, generally speaking, the present invention is directed to a system for sealingly securing a flexible bag to a non-circular base. As illustrated in the drawings, this system includes the substantially rigid, non-circular base 26 for supporting the bag 22, channels 50 formed in the base extending at least partially around the base for receiving a portion of the bottom margin 66 of the bag, a plurality of locking strips 76 which are adapted to placed in the channels in a position overlying the bottom margin of the bag, and a clamping mechanism 28 securable to the base for applying pressure to the locking strips to press the bottom margin of the bag against one or more surfaces of the channels thereby to sealingly secure the bag to the base.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A container for holding fluent material comprising, a bag of flexible sheet material defining a volume for containing a load of the material, said bag having a side wall with an inside face and an outside face, and a bottom margin defining an open lower end of the bag, a substantially rigid, non-circular base for supporting the bag, channel means formed in the base and extending at least partially around the base, the bag fitting on the base with the bottom margin of the bag extending down on the outside of the base and with a portion of the bottom margin being received in said channel means, locking strip means disposed in said channel means and positioned to overlie said portion of the bottom margin of the bag, and a clamping mechanism securable to the base for holding said locking strip means in said channel means in a position wherein said locking strip means presses said portion of the bottom margin of the bag against one or more surfaces of said channel means thereby to sealingly secure the bag to the base.

2. A container as set forth in claim 1 wherein said channel means has a bottom and a pair of side walls, and wherein said locking strip means has a width which is only slightly less than the width of said channel means between the side walls thereof, so that said portion of the bottom margin of the bag is compressed between said locking strip means and the side walls of said channel means.

3. A container as set forth in claim 1 wherein said base is generally rectangular in shape having opposite sides and opposite ends.

4. A container as set forth in claim 3 wherein said channel means comprises a plurality of channels extending along opposite sides and opposite ends of the base, and wherein said locking strip means comprises a plurality of locking strips received in respective channels.

5. A container as set forth in claim 4 wherein the width of each locking strip is slightly less than the width of the respective channel.

6. A container as set forth in claim 5 wherein each channel has a bottom and a pair of side walls, and wherein the portion of the bottom margin of the bag in the channel is compressed between the locking strip and the side walls of the channel.

7. A container as set forth in claim 1 wherein said base is formed with a peripheral flange projecting laterally outwardly from the base, said flange having an upper surface, an outer face extending down from the upper surface, and a lower surface, and wherein said channel means is formed in the upper surface of the flange.

8. A container as set forth in claim 7 wherein said clamping mechanism comprises a clamp generally channel-shaped in cross section, said clamp having an upper rim overlying the upper surface of the flange, a lower rim underlying the lower surface of the flange, and a web connecting the upper and lower rims on the outside of the outer face of the flange.

9. A container as set forth in claim 8 wherein said portion of the bottom margin of the bag is an upper portion of the bottom margin extending laterally outwardly from the side wall of the bag across the upper surface of the flange and into said channel means, said upper portion being received in said channel means, said bottom margin further comprising an outer portion extending down from the upper portion on the outside of the outer face of the flange, and a lower portion extending laterally inwardly from the outer portion to underlie the lower surface of the flange.

10. A container as set forth in claim 9 wherein said bottom margin of the bag has a hem around the bottom margin of the bag on the outside face of the bag, said hem having an upper portion underlying the upper rim of the clamp and overlying the upper surface of the flange and said locking strip means, an outer portion extending down from the upper portion between the web of the clamp and the outer portion of the bottom margin of the bag, and a lower portion extending laterally inwardly from the outer portion between the lower rim of the clamp and the lower portion of the bottom margin of the bag.

11. A container as set forth in claim 10 wherein both the lower portion of the hem and the lower portion of the bottom margin extend down below the lower rim of the clamp and wherein the clamping system further comprises a safety clamp securable to the base for applying pressure to the portions of the hem and bottom margin extending below said lower rim of the clamp to secure said portion of the hem against the base.

12. A container as set forth in claim 10 wherein the base is generally rectangular with opposite sides and opposite ends, and wherein said channel means comprises a plurality of channels extending along said opposite sides and opposite ends of the base, said locking strip means comprises a plurality of locking strips received in respective channels, and wherein the combined thickness of the locking strip and the bottom margin of the bag is greater than the depth of the channel.

13. A container as set forth in claim 12 wherein the combined thickness of the locking strip and the bottom margin of the bag is greater than depth of channel by the thickness of the bottom margin.

14. A container as set forth in claim 7 wherein said flange has rounded corners, wherein said channel means comprises a plurality of channels extending along opposite sides and opposite ends of the base and terminating prior to the rounded corners of the flange, and wherein said locking strip means comprises a plurality of locking strips received in respective channels.

15. A container as set forth in claim 14 wherein said flange bows laterally outwardly at opposite sides and opposite ends of the base.

16. A container as set forth in claim 15 wherein the plurality of channels and plurality of locking strips are bowed generally to correspond to the shape of the flange.

17. A container as set forth in claim 15 wherein said clamping mechanism comprises an annular clamp fitted on said flange and extending around the base, said clamp being generally channel-shaped in cross section and having an upper rim overlying the upper surface of the flange, a lower rim underlying the lower surface of the flange, and a web connecting the upper and lower rims on the outside of the outer face of the flange.

18. A container as set forth in claim 17 wherein said annular clamp comprises a plurality of separate segments, each segment having opposite ends, and a plurality of connectors for drawing the ends of the segments toward one another to tighten the clamp on the flange.

19. A container as set forth in claim 18 wherein each clamp section is generally J-shaped having a relatively long section which extends along one of a respective side and end of the base and a curved section which extends around a respective corner of the base.

20. A container as set forth in claim 1 wherein said clamping mechanism comprises an annular clamp having a plurality of separate segments, each segment having opposite ends, and a plurality of connectors for drawing the ends of the segments toward one another to tighten the clamp around the base.

21. A system for securing a bag to a non-circular base, said bag being of flexible sheet material and having a side wall with an inside face and an outside face, and a bottom margin defining an open lower end of the bag, said system comprising a substantially rigid, non-circular base for supporting the bag, channel means formed in the base and extending at least partially around the base, said bag being adapted to fit on the base with the bottom margin of the bag extending down on the outside of the base and with a portion of the bottom margin being received in said channel means, locking strip means adapted to placed in said channel means in a position overlying said portion of the bottom margin of the bag, and a clamping mechanism securable to the base for applying pressure to said locking strip means to press said portion of the bottom margin of the bag against one or more surfaces of said channel means thereby to sealingly secure the bag to the base.

* * * * *